US006659387B2

(12) United States Patent
Biagioni et al.

(10) Patent No.: US 6,659,387 B2
(45) Date of Patent: Dec. 9, 2003

(54) PERIPHERAL REWINDING MACHINE AND METHOD FOR PRODUCING LOGS OF WEB MATERIAL

(75) Inventors: Mauro Biagioni, San Pietro a Vico Lucca (IT); Sergio Casella, Fornoli Lucca (IT)

(73) Assignee: Paper Converting Machine Co., Green Bay, WI (US)

( * ) Notice: Subject to any disclaimer, the term of this patent is extended or adjusted under 35 U.S.C. 154(b) by 98 days.

(21) Appl. No.: 09/986,219

(22) Filed: Oct. 22, 2001

(65) Prior Publication Data

US 2002/0066820 A1 Jun. 6, 2002

Related U.S. Application Data

(63) Continuation-in-part of application No. 09/942,275, filed on Aug. 27, 2001, now abandoned.

(30) Foreign Application Priority Data

Nov. 7, 2000 (IT) ..... MI2000A2399

(51) Int. Cl.[7] ..... B65H 18/16; B65H 19/26

(52) U.S. Cl. ..... 242/527.3; 242/521; 242/542.1; 242/542.2

(58) Field of Search ..... 242/527.3, 527.4, 242/521, 533.2, 541.5, 541.6, 542.1, 542.2

(56) References Cited

U.S. PATENT DOCUMENTS

| | | | | |
|---|---|---|---|---|
| 4,327,877 A | | 5/1982 | Perini | |
| 4,516,735 A | * | 5/1985 | Snygg | 242/527.3 |
| 4,723,724 A | | 2/1988 | Bradley | |
| 4,828,195 A | | 5/1989 | Hertel et al. | |
| 4,909,452 A | | 3/1990 | Hertel et al. | |
| 5,040,738 A | | 8/1991 | Biagiotti | |
| 5,104,055 A | | 4/1992 | Buxton | |
| 5,137,225 A | | 8/1992 | Biagiotti | |
| 5,368,252 A | | 11/1994 | Biagiotti | |
| 5,370,335 A | | 12/1994 | Vigneau | |
| 5,421,536 A | | 6/1995 | Hertel et al. | |
| 5,505,405 A | | 4/1996 | Vigneau | |
| 5,542,622 A | | 8/1996 | Biagiotti | |
| 5,979,818 A | | 11/1999 | Perini et al. | |
| 6,056,229 A | | 5/2000 | Blume et al. | |
| 6,098,916 A | * | 8/2000 | Matteucci et al. | 242/527.3 |
| 6,338,451 B1 | * | 1/2002 | Dorfel et al. | 242/527.3 |

FOREIGN PATENT DOCUMENTS

| | | |
|---|---|---|
| GB | 1435525 | 5/1976 |
| GB | 2105688 | 9/1981 |

* cited by examiner

*Primary Examiner*—John M. Jillions

(57) ABSTRACT

A rewinding machine for the production of logs of web material around a tubular core includes a first winding roller around which the web material is fed, a second winding roller forming a gap with the first winding roller, through which gap the core is inserted, and a third roller mounted movably to allow the diameter of the log to increase and the log to be discharged at the end of winding. A blade is carried by a rotating member which is pivoted on the axis of said first winding roller and protrudes from the profile of the roller. The blade rotates in the same direction as the first winding roller at different speeds, so as to undergo a deceleration or an acceleration when it is in contact with the web material in the winding space defined by the three rollers to cause severing of the web material at the end of winding.

16 Claims, 7 Drawing Sheets

PERIPHERAL REWINDING MACHINE AND METHOD FOR PRODUCING LOGS OF WEB MATERIAL

RELATED APPLICATION

This application is a continuation-in-part of U.S. Ser. No. 09/942,275, filed Aug. 27, 2001 now abandoned entitled "Peripheral Rewinding Machine and Method for Producing Logs of Web Material."

BACKGROUND

The present invention relates to a peripheral rewinding machine and a related rewinding method for the production of rolls or logs of web material, such as paper and the like, on a tubular support or core.

In a peripheral or surface rewinding machine of the type to which the invention refers, the roll is wound around a tubular core which is set in rotation between a group of three rollers that act on the periphery of the roll being formed, and the speeds of which are kept constant and equal during the winding cycle.

The group of three motorized rollers forms a space of variable size so that the three rollers are always in contact with the roll being formed, as the roll increases in diameter. Two of the three rollers are placed at a fixed distance, so as to define a gap, through which the core is inserted, and in which the web material travels, whilst the third roller or pressure roller is movable to allow the diameter of the roll to increase and the roll to be expelled at the end of winding.

In these rewinding machines the so-called changeover stage, sometimes called cutoff and transfer, is important. That stage includes insertion of a new core in the winding space, accompanied by a special inserter, and discharge of the completed log, following severing of the web material. This severing is obtained in various ways according to the prior art, generally requiring sudden changes in the speed of two of the three winding rollers.

According to some known methods, the speed change of said rollers alone, which is naturally of rather a large magnitude, causes tensioning and tearing of the web of paper following nipping thereof against the roller along which it is fed, nipping which can take place by means of a new core which is inserted in the winding space. After severing of the web of paper, entry of the new core into the winding space and discharge of the formed log take place through differences in speed between the two input rollers and the two output rollers, respectively.

As stated previously, this method of severing the paper requires large variations in speed between the rollers, and in particular strong accelerations of the pressure roller, which cause stress on the structure of the machine. Moreover, such methods make it difficult to sever the web material along a single pre-selected perforated line to provide the completed log with exact sheet count.

Other systems use true cutting blades that cut the web at the end of winding and require complicated actuating mechanisms. Moreover, they are not very flexible in that they are tied to carrying out the cut on well-defined lengths of web material.

SUMMARY OF THE INVENTION

The object of the invention is to eliminate the drawbacks of the solutions of the prior art, and therefore to provide a rewinding machine and a rewinding method that are reliable and simple to create and ensure precise cutting of the web material.

This object is achieved with the rewinding machine and method according to the appended independent claims. Preferred embodiments of the invention are apparent from the dependent claims.

Substantially, according to the invention, a blade is carried by a rotating member which is pivoted on the axis of the roller around which the web material is wound and rotates in the same direction as the roller is provided. The rotating member is actuated when the log is in the completion stage at a speed equal to or substantially similar to that of the web material, to be subsequently slowed or accelerated when it is inside the winding space, to cause tensioning and severing of the web material. Normally severing of the material takes place along a line of perforation in the web.

Further characteristics of the invention will be made clearer by the detailed description that follows, referring to a purely exemplary and therefore non-limiting embodiment.

DESCRIPTION OF THE DRAWINGS

The invention will be explained in conjunction with the drawings, in which

FIGS. 1A to 6A are views like that in FIG. 1, illustrating successive stages of the winding cycle according to a first embodiment of the invention;

FIGS. 1B to 6B are views like that in FIG. 1, illustrating successive stages of the winding cycle according to a second embodiment of the invention.

DESCRIPTION OF SPECIFIC EMBODIMENT

Figure 1:
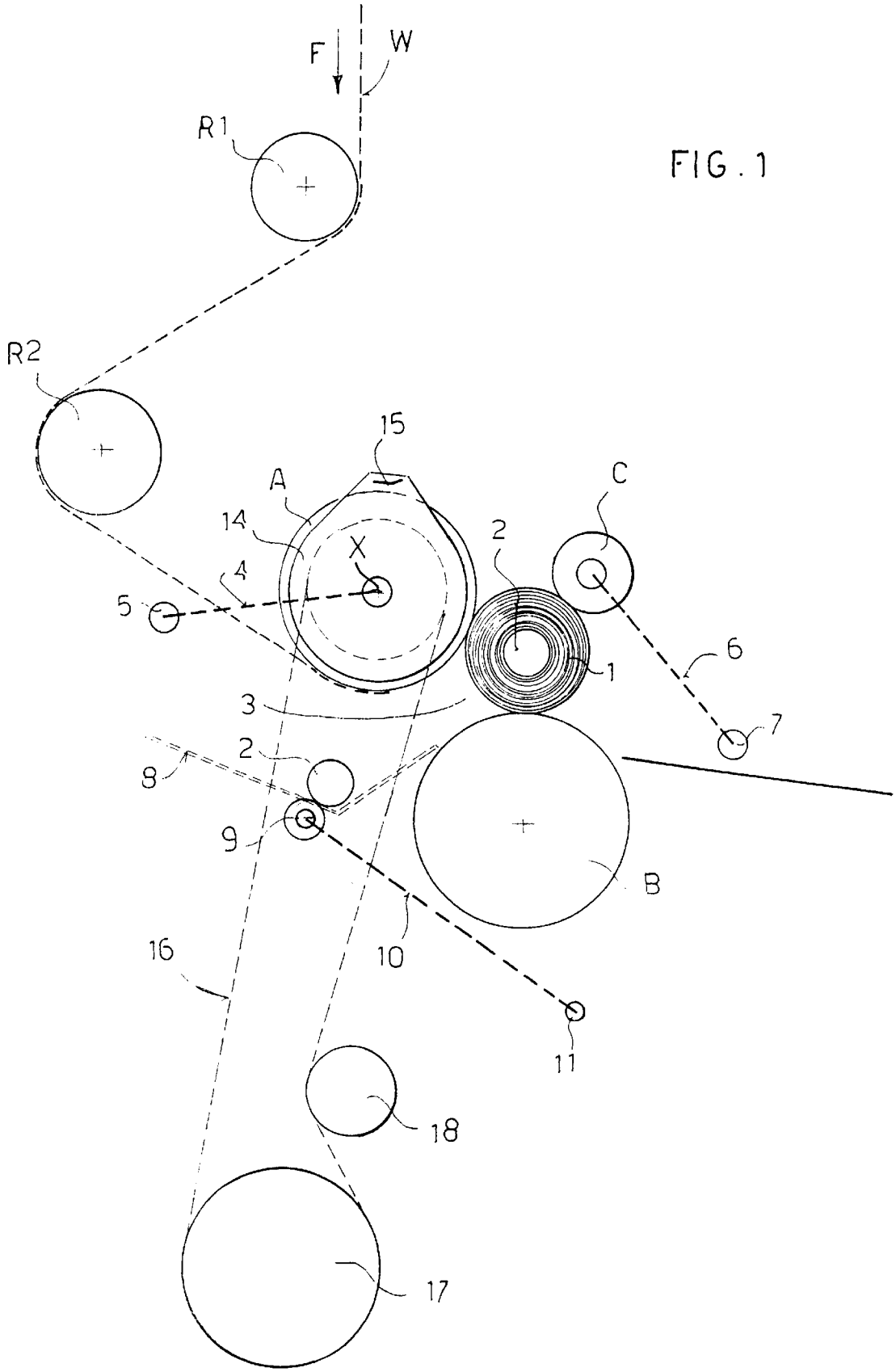
FIG. 1 is a schematic side view of the basic elements of the rewinding machine according to the invention.

With reference to said figures, for now in particular to FIG. 1, which schematically illustrates a few more elements of the machine, a brief description of said elements will be made. In the description that follows, reference will be made in the singular to the elements shown in the drawings, it nevertheless being obvious that many of them, such as the arms and levers, are disposed in pairs, at the two sides of the machine.

In the appended figures, W designates a web material, in particular paper, which is unwound from a large-sized roll, not shown, and, travelling in the direction of the arrow F, is suitably tensioned by rollers R1 and R2 and wound around a first winding roller A, to be rewound in rolls or logs 1, of a considerably smaller diameter, around a tubular central core 2.

The first winding roller A is associated with a second winding roller B, which defines therewith a gap 3, through which the cores 2 are inserted. The width of the gap 3 is constant during operation of the machine and not greater than the diameter of the core so that the latter enters the gap with slight forcing. One of the two rollers A, B, in the example shown the first winding roller A, is supported by a mobile arm 4, schematised in the figure, pivoted at 5, to adjust the width of the gap 3 to the diameter of the core 2 which is used.

The group of three winding rollers is completed by a third roller C, also called a pressure roller, supported by an arm 6 movable around a fulcrum 7, according to a pre-determined law of motion, to allow the roll 1 to be increased in diameter and discharged at the end of winding. The rollers A, B, and C are rotatably mounted in a frame (not shown) and may be controlled by conventional servo motors.

Upstream of the gap 3 a feed slide 8 is provided for the cores 2. A core inserting device comprising idler rollers 9 is carried at the end of an arm 10 pivoted at 11. The arm 10, which in the appended figures has been schematised with a segment of straight line, in fact has, in a per se known manner, a beak shape so as to push the core 2 into the winding space without interfering with the winding roller B.

A rotating member 14 carrying a blade 15 protruding beyond the profile of the roller A is pivoted on the axis X of the first winding roller A. The member 15 has been called and will henceforth be called a blade, in that it causes severing of the web material, as will be explained below, but in fact it may not have, and preferably does not have, knife-type cutting edges.

The rotating member 14 is driven in rotation in the same direction as the roller A, which is anticlockwise in the appended figures, and is motorized separately by means of a belt drive 16 actuated by a motorized wheel 17 and passing round a tensioning roller 18. Obviously, other actuating means can be provided for the rotating member 14, such as, for example, chains, gears and the like. The wheel 17 can be controlled by a servo motor.

Operation of the machine according to two different embodiments, shown respectively in FIGS. 1A to 6A and 1B to 6B, will now be illustrated, using in both cases the same reference numerals to designate like or similar parts.

In the embodiment according to FIGS. 1A to 6A, the blade 15 has a concave shape toward the outside, substantially a very wide V shape, with the first leg, in the direction of rotation, longer than the other and less inclined with respect to the tangent to the winding roller A.

Figure 1A:
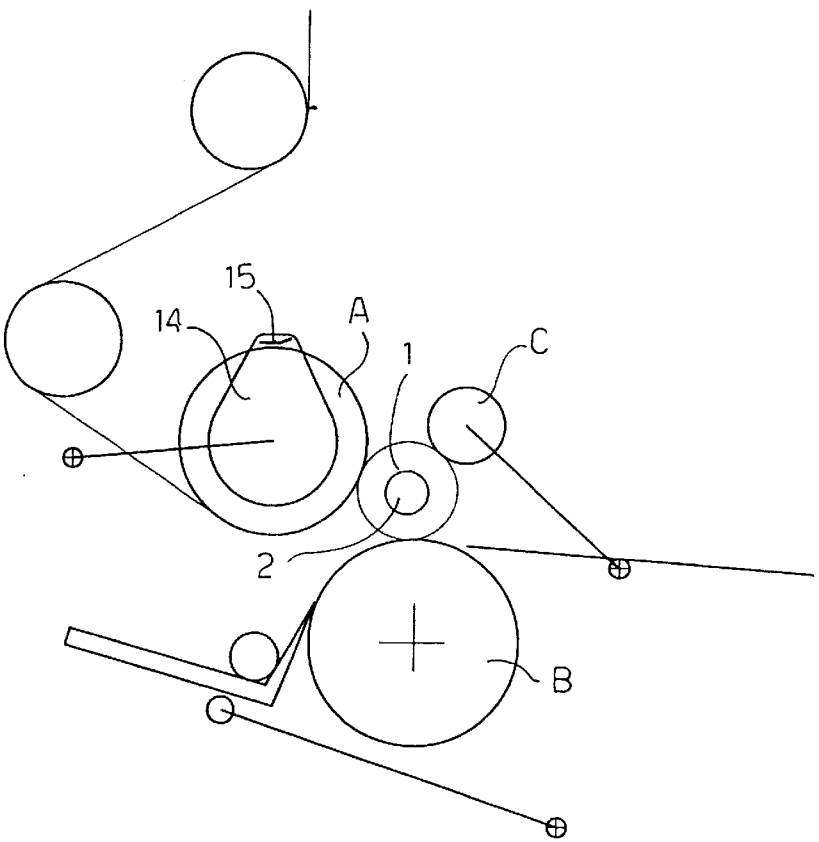
Figure 2B:
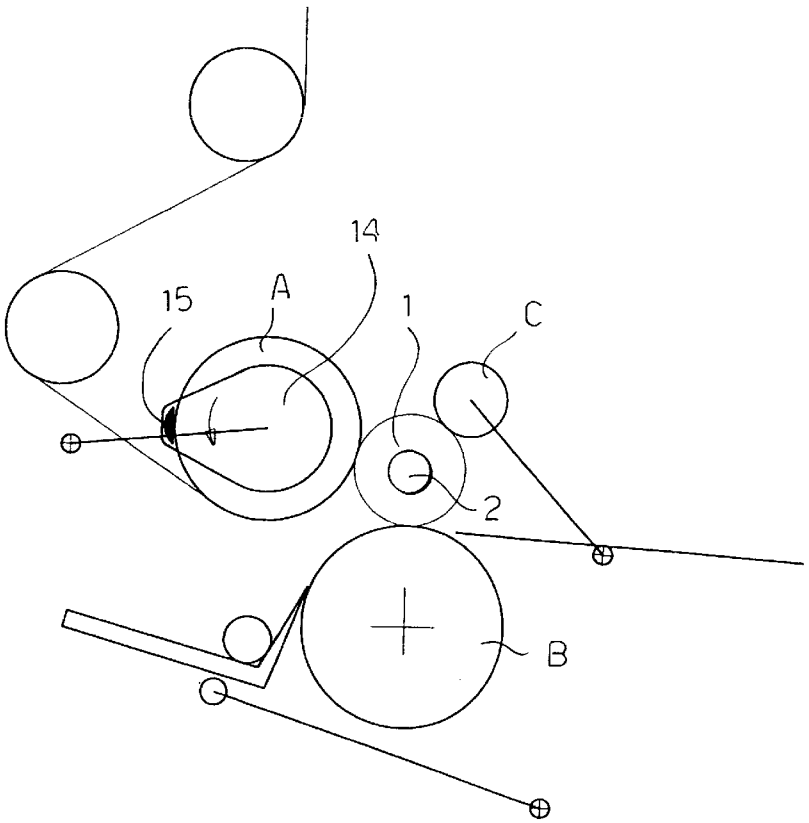
Figure 1B:
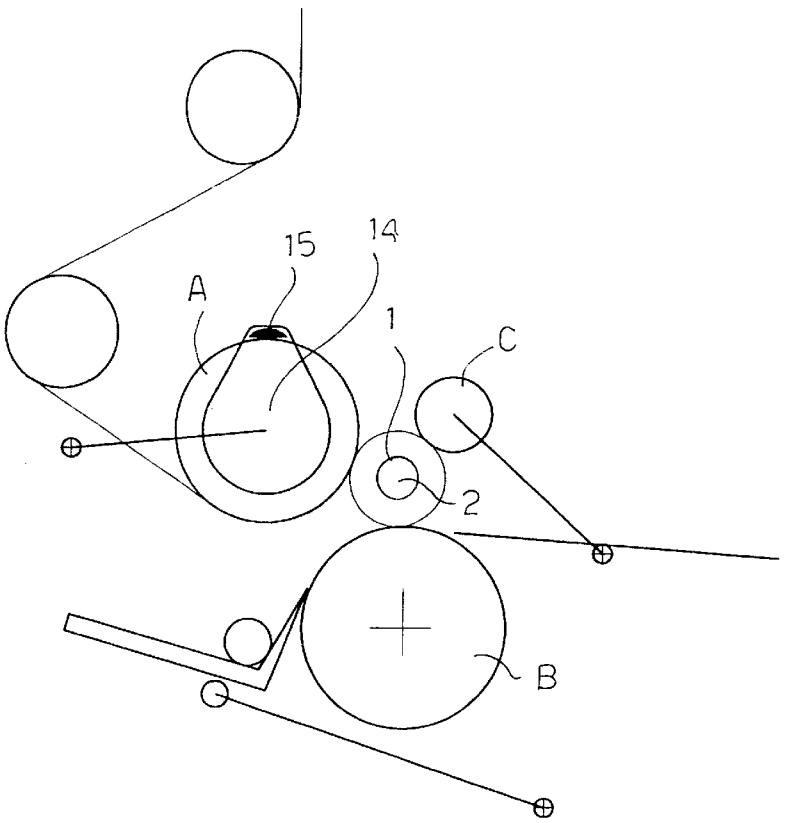

FIG. 1A illustrates the configuration of the machine during winding of the roll 1, with the blade 15 in the resting position, that is with the rotating member 14 at a standstill. In this condition, the three rollers A, B, C all rotate at a constant and substantially the same speed, a speed which corresponds to the feeding speed of the web material.

Figure 2A:
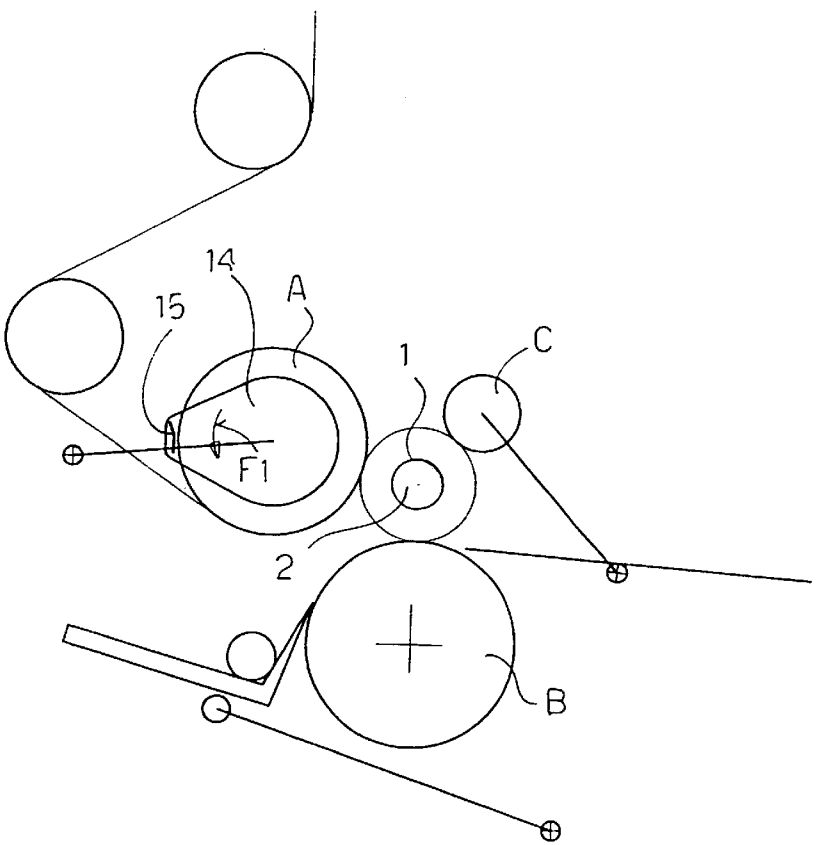

In FIG. 2A the machine is near the changeover, that is about at the end of winding of roll 1, when said roll is about to be discharged and a new core 2 must be inserted. In this stage the blade 15, together with the rotating member 14, is set in rotation by the motorized wheel 17 and the belt drive 16 in the same direction of rotation as roller A, indicated by the arrow F1 in the appended figures. After an initial acceleration stage, the blade 15 reaches the same speed, or a very similar speed, as that of the web material W.

Figure 3A:
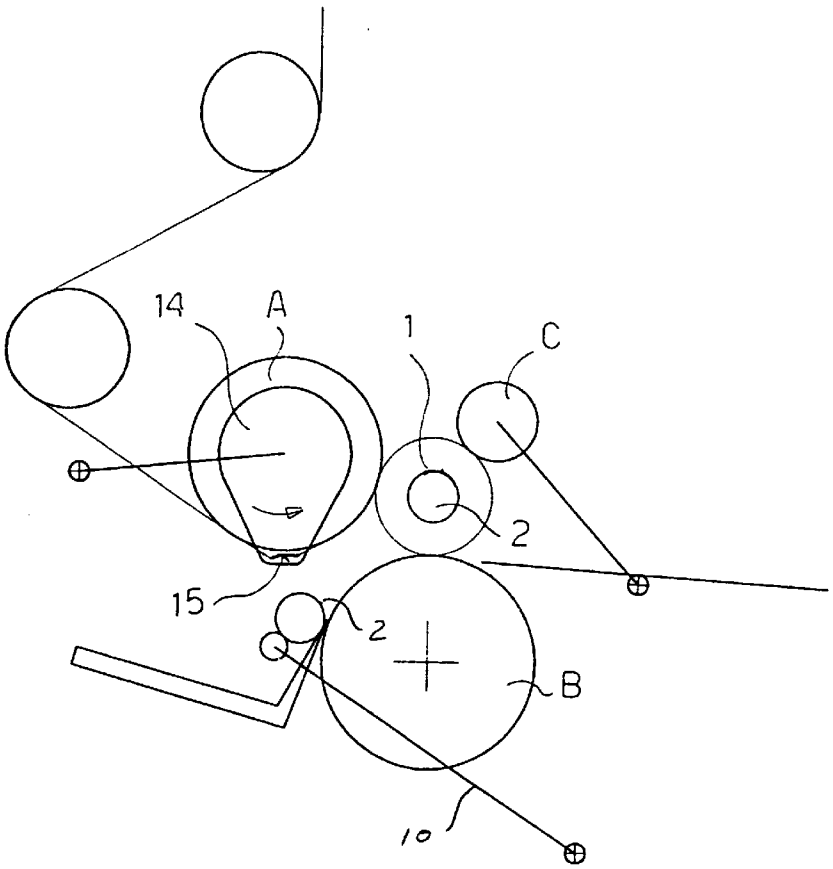

In the stage illustrated in FIG. 3A, the blade 15, which travels at substantially the same speed as that of the web material W, has slightly raised the material W from the profile of the winding roller A and is accompanying it into the winding space. Again in this stage, the core inserting arm 10 begins to rise to bring a new core 2 into the gap between the two rollers A, B.

Figure 4A:
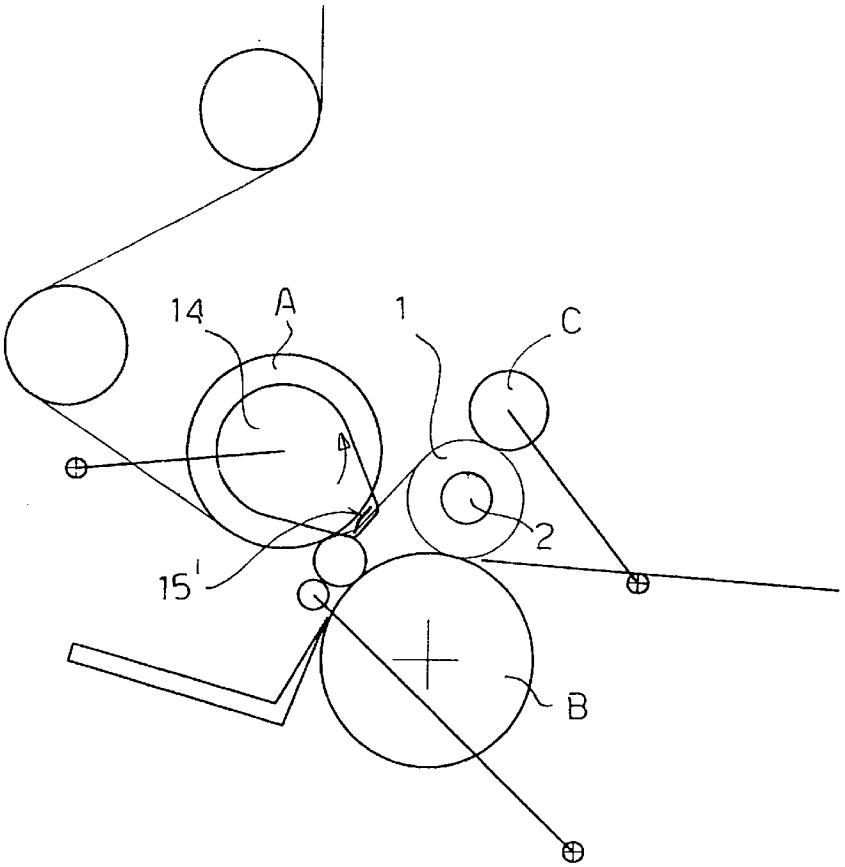
Figure 5A:
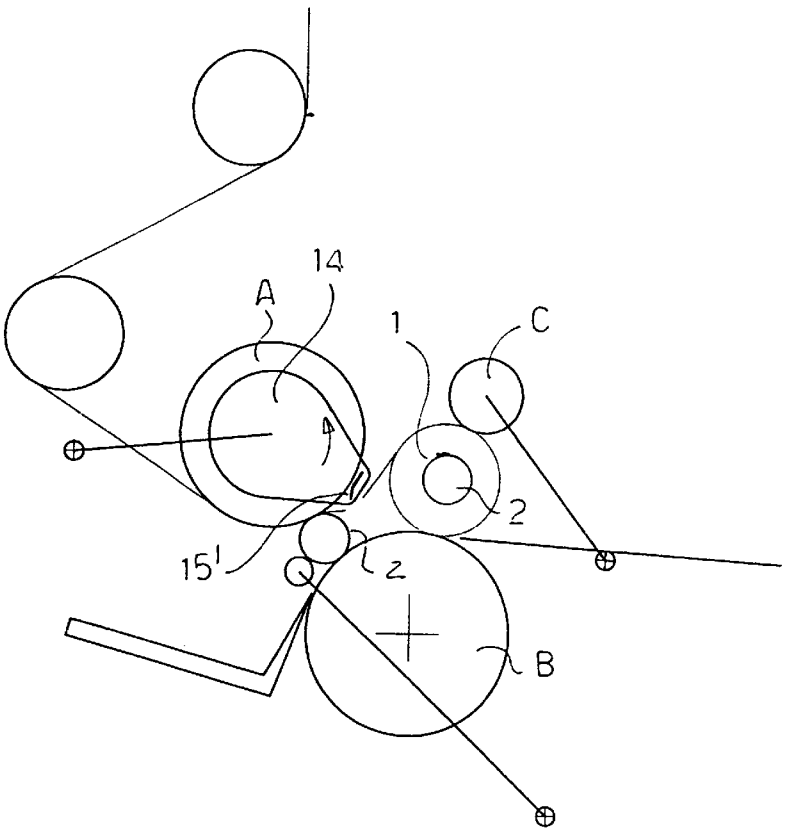
Figure 6B:
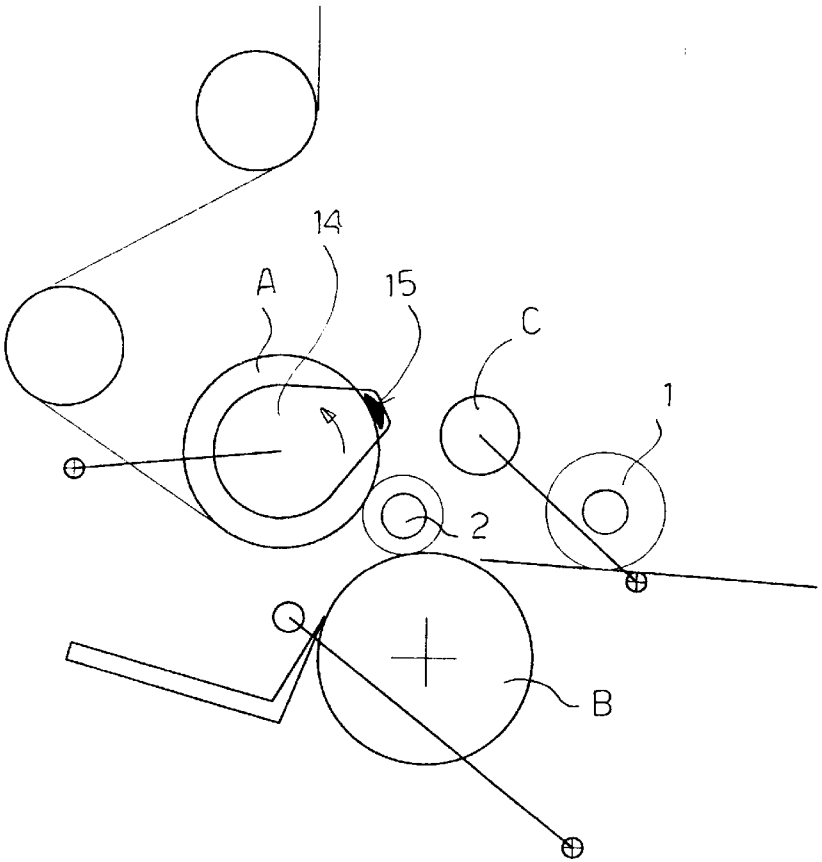
Figure 5B:
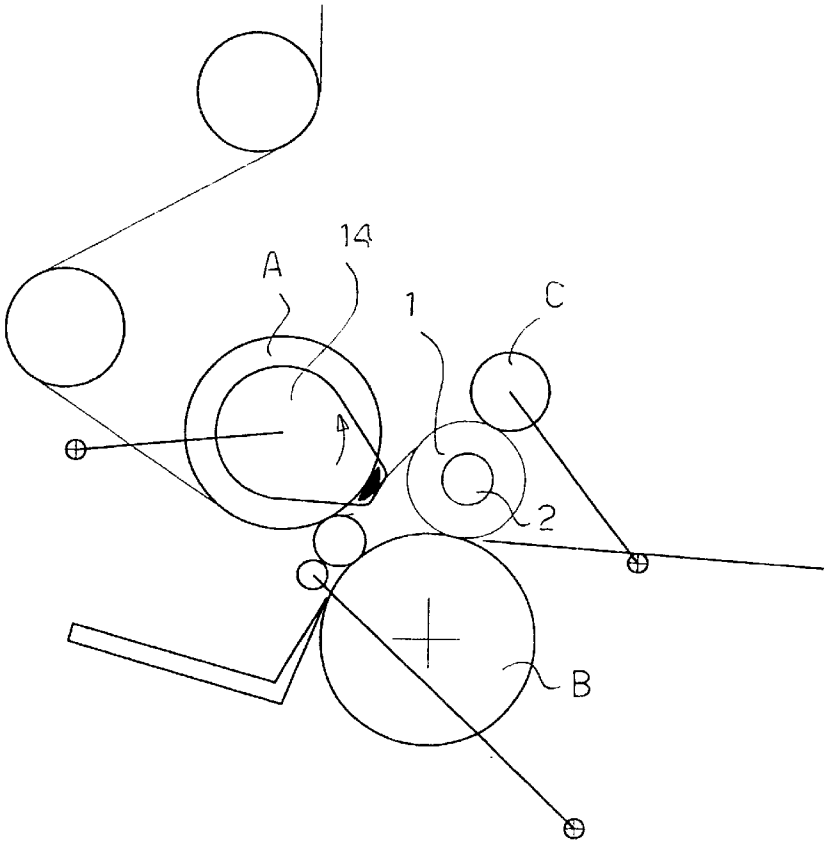

In FIG. 4A the log 1 is practically completed and severing of the web material is taking place. In this stage the pressure roller C has begun an acceleration stage, and the bottom roller B is possibly slowed, causing the roll 1 to move toward the outlet from the winding space. At the same time, or with slight staggering with respect to the acceleration of the pressure roller C, the blade 15 is slowed, so that the web material W has to slide on the contact edge 15' of the blade 15. In this situation, a transverse line of perforation of the web material comes to pass on the point of contact 15' with the blade 15, and tensioning of the web material due to acceleration of the pressure roller C causes such a lengthening as to cause separation of the material at said line of perforation, as shown in FIG. 5A.

It can be advantageous for the blade 15 to have a high coefficient of friction, at least at the point of contact 15' with the web material W, so as to facilitate severing of the web material. However, depending upon the types of material to be wound, the various types of perforations adopted, or even the lack of perforations on the web material, the blade 15 can assume different configurations, for example, with a continuous edge, serrated, or the like.

Returning to FIG. 5A, it can be noted that a new core 2, on which an adhesive has previously been spread, comes into contact with the already separated web material W, beginning to wind it on itself, thus starting formation of a new roll 1, which is moved into the winding space by a possible difference in speed between the rollers A and B, the latter having previously been decelerated.

Figure 6A:
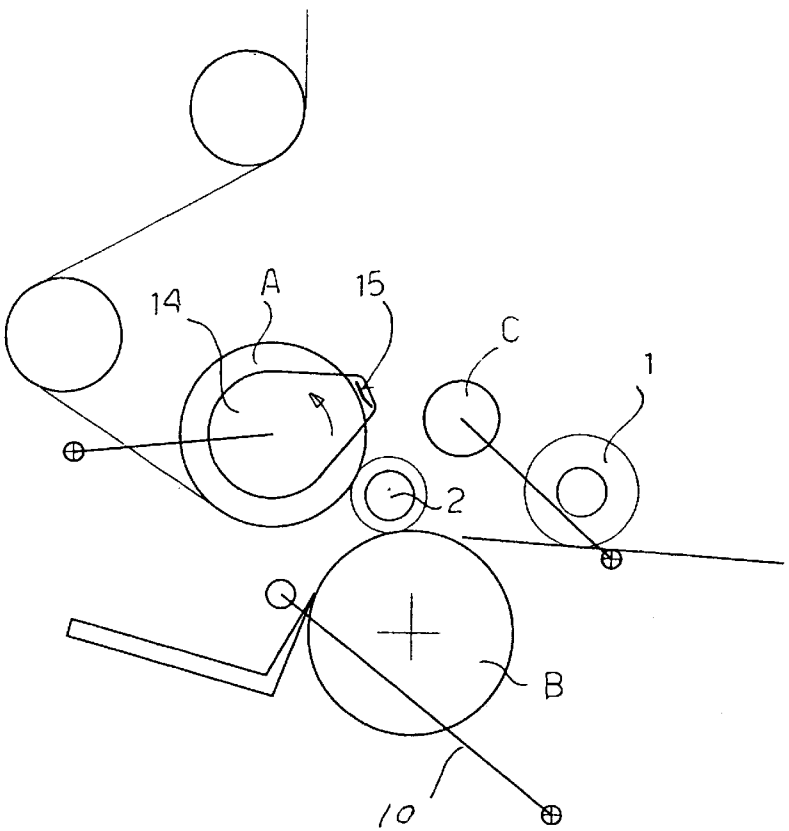

This situation is shown in FIG. 6A, where the formed log has been expelled and a new log being formed is entering the winding space. The blade 15 is moving into the resting position and the core inserting arm 10 is going back to pick up a new core, to start a new winding cycle, and the three rollers A, B, C begin to rotate again at the same speed.

In the embodiment illustrated in FIGS. 1B to 6B, the same series of stages is shown as in FIGS. 1A to 6A of the first embodiment, therefore they will not be described in detail.

The substantial difference of this second embodiment with respect to the first lies in the fact that the blade 15 is accelerated instead of decelerated to cause separation of the web material W. For this purpose, the blade 15, made of a material with a high coefficient of friction, is advantageously given a convex profile toward the outside.

Figure 4B:
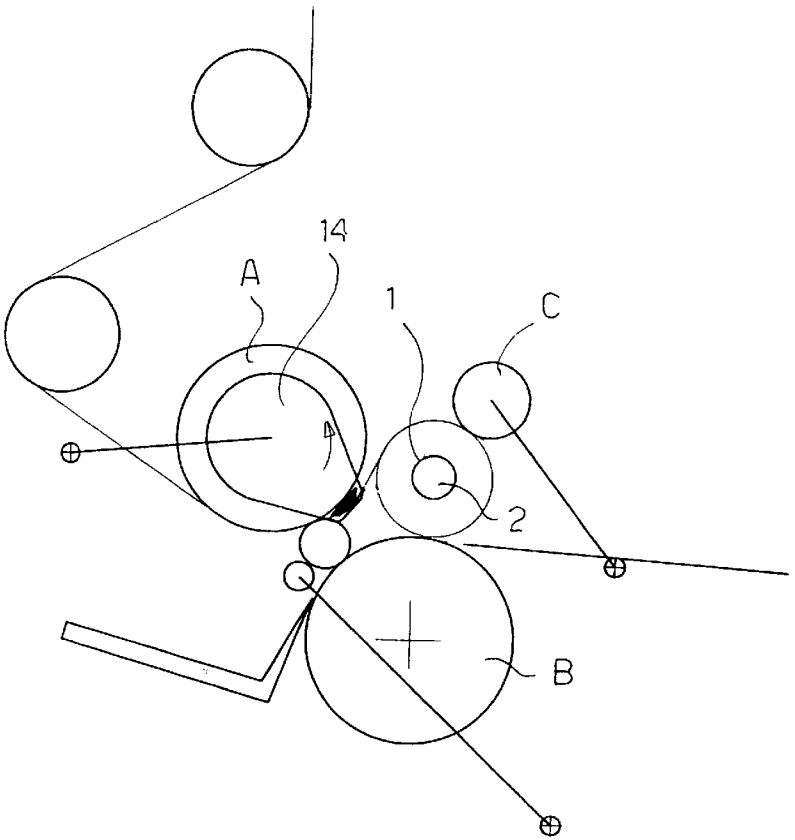
Figure 3B:
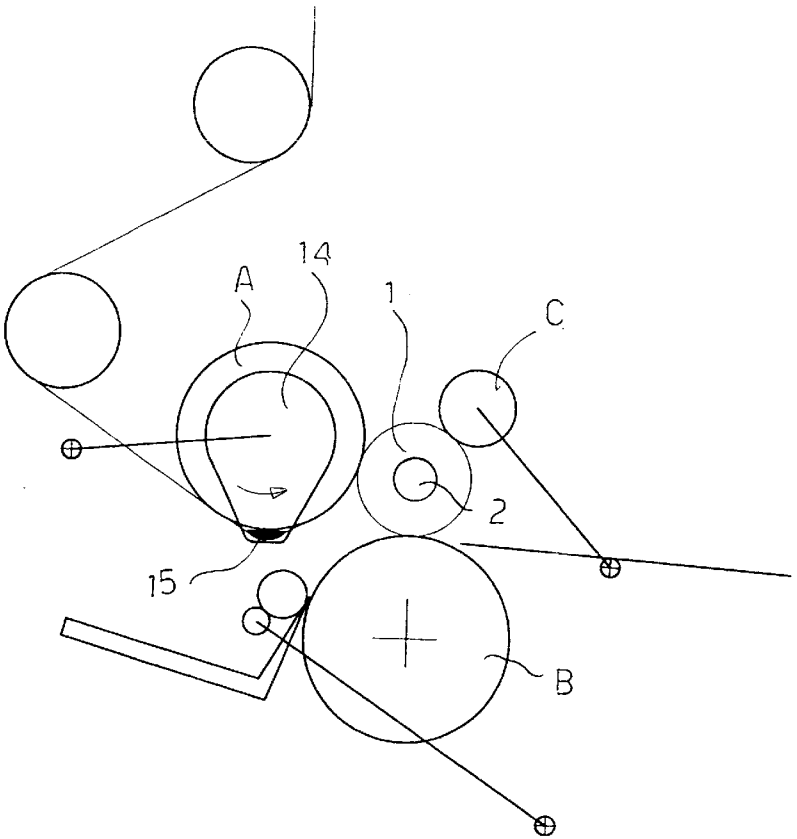

In the situation in FIG. 4B, the acceleration of the blade 15 with the strong grip on the portion of web material W nipped by the new core 2 against the upper winding roller A, causes a further stretching of the web material and thus severing along the line of perforation between the core being inserted and the blade.

Of course the invention is not limited to the particular embodiments previously described and illustrated in the appended drawings, but numerous changes of detail within the reach of a person skilled in the art can be made thereto, without thereby departing from the scope of the invention, as defined by the appended claims.

We claim:

1. A peripheral rewinding machine for the production of logs of web material on a core, comprising a first winding roller on which the web material may be wound, the first roller having an axis about which the roller rotates, a second winding roller defining with the first winding roller a gap through which a core may be inserted, a third roller movably mounted to allow the diameter of a log to increase and the log to be discharged at the end of winding, the first, second, and third rollers defining a winding space, means for severing the web material at the end of winding, and means for inserting a new core, characterized in that said means for severing the web material comprises a blade carried by a rotating member pivoted on the axis of said first winding roller and protruding from said first winding roller and in that actuating means are provided for causing the blade to rotate at different speeds in the same direction of rotation as said first winding roller such as to impart a change in speed to the blade when the blade is in contact with the web material in the winding space bed defined by said three rollers.

2. A rewinding machine according to claim 1, characterized in that said blade has at least one coating of a material with a high coefficient of friction, such as to provide a strong grip with the web material.

3. A rewinding machine according to claim 1, characterized in that said actuating means for the blade causes the blade to decelerate when the blade is in contact with the web material in the winding space, so as to cause severing of the web material between the point of contact of the web material with the blade and a log.

4. A rewinding machine according to claim 1, characterized in that said actuating means for the blade causes the blade to accelerate when the blade is in contact with the web material in the winding space, so as to cause severing of the web material between the point of nipping of the web material caused by the contact of a new core with the first winding roller and the point of contact of the blade with the web material.

5. A winding machine according to claim 1, characterized in that said web material includes predefined transverse lines of perforation along which severing of the web material takes place.

6. A rewinding machine according to claim 1, characterized in that means are provided to accelerate rotation of said third roller during severing of the web material.

7. A rewinding machine according to claim 1, characterized in that means are provided to decelerate rotation of said second winding roller during severing of the web material.

8. A rewinding machine according to claim 1, characterized by means for rotating said rotating member and said blade and independent means for rotating said first winding roller.

9. A method of producing logs of web materials, such as paper and the like, comprising the steps of:

mounting a first winding roll for rotation about a first axis of rotation, rotatably mounting a second winding roller, rotatably mounting a third winding roller, the first, second, and third winding rollers defining a winding space, rotatably mounting a blade for rotation about said first axis of rotation for rotation at different speeds, the blade protruding from the first winding roller, feeding web material along the first winding roller and onto a core rotating in the winding space to form a log, and rotating the blade into contact with the web and changing the speed of rotation of the blade when it is in contact with the web material in the winding space so that the web is severed.

10. The method of claim 9 including the step of providing the blade with the high coefficient of friction whereby the blade strongly grips the web material.

11. The method of claim 9, including the step of decelerating the blade when the blade is in contact with web material in the winding space to cause severing of the web material between the point of contact of the blade with the web material and a log.

12. The method of claim 9 including the steps of introducing a new core between the first and second winding rollers and accelerating the blade when the blade is in contact with web material in the winding space so that the web material is severed between the point of nipping of the web material determined by contact of the new core with the first winding roller and the point of contact of the blade with the web material.

13. The method of claim 9 in which the web includes transverse lines of perforation and including the step of severing the web material along one of the lines of perforation.

14. The method of claim 9 including the step of accelerating the rotation of the third winding roller during severing of the web material.

15. The method of claim 9 including the step of decelerating the rotation of the second winding roller during severing of the web material.

16. The method of claim 9 including the step of rotating the blade independently of the first winding roller.

* * * * *